US006894953B2

(12) United States Patent
Otto

(10) Patent No.: US 6,894,953 B2
(45) Date of Patent: May 17, 2005

(54) CIRCUIT FOR MEASURING TIME OF ARRIVAL OF AN ASYNCHRONOUS EVENT

(75) Inventor: Vedon Otto, Burleson, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 337 days.

(21) Appl. No.: 10/062,938

(22) Filed: Feb. 1, 2002

(65) Prior Publication Data

US 2003/0048699 A1 Mar. 13, 2003

Related U.S. Application Data

(60) Provisional application No. 60/322,085, filed on Sep. 12, 2001.

(51) Int. Cl.[7] ..... G04F 10/00
(52) U.S. Cl. ..... 368/113; 368/118
(58) Field of Search ..... 368/113, 118, 368/120; 327/20, 31; 377/20, 33, 56

(56) References Cited

U.S. PATENT DOCUMENTS 3,631,343 A 12/1971 Schmidhauser
3,984,815 A 10/1976 Drexler et al.
4,468,746 A 8/1984 Davis
4,651,232 A * 3/1987 Lemoine et al. ..... 386/13
5,045,854 A * 9/1991 Windmiller ..... 341/97
5,166,959 A * 11/1992 Chu et al. ..... 377/20
5,199,008 A 3/1993 Lockhart et al.
5,703,838 A * 12/1997 Gorbics et al. ..... 368/120
5,784,599 A * 7/1998 Elkhoury ..... 713/501
5,978,113 A * 11/1999 Kight ..... 398/1

FOREIGN PATENT DOCUMENTS

EP 0717329 A2 6/1996

* cited by examiner

*Primary Examiner*—David Martin
*Assistant Examiner*—Thanh S. Phan
(74) *Attorney, Agent, or Firm*—Bracewell & Patterson, L.L.P.

(57) ABSTRACT

A timing circuit for measuring time of arrival of an asynchronous event is disclosed. The timing circuit includes a counter, a register, a gray code-to-binary converter, and a cascade circuit. In response to a time of arrival of a trigger signal that denotes an occurrence of an asynchronous event, the counter generates a set of high-order binary bits and the register generates a set of gray code bits. The gray code-to-binary converter then converts the set of gray code bits to a set of low-order binary bits. Finally, the cascade circuit concatenates the high-order binary bits and the low-order binary bits to form the time of arrival of the asynchronous event.

20 Claims, 3 Drawing Sheets

CIRCUIT FOR MEASURING TIME OF ARRIVAL OF AN ASYNCHRONOUS EVENT

RELATED PATENT APPLICATION

The present patent application claims priority to application U.S. Ser. No. 60/322,085, filed on Sep. 12, 2001 now abandoned.

BACKGROUND OF THE INVENTION

1. Technical Field

The present invention relates to digital circuits in general, and in particular to digital timing circuits. Still more particularly, the present invention relates to a digital timing circuit for measuring time of arrival of an asynchronous event.

2. Description of the Related Art

Certain applications require a determination of the arrival time of an asynchronous event. For example, the precise distance between a laser source and a target can be ascertained by determining the time of flight for a laser light to travel from the laser source to the target. The time when the laser light hits the target is considered as an asynchronous event. Other applications include locating a vessel by measuring the time of flight of an electromagnetic signal from three reference transponders to the vessel that carries a fourth transponder.

Most prior art digital timing circuits utilized to perform any of the above-mentioned timing determination are typically not very precise. Common solution for increasing the precision of prior art timing circuits may include increasing the stability of reference clocks, increasing the speed of reference clocks, eliminating sources of certain kinds of jitter, etc. Although such solutions have been successful in a few applications, they are also very expensive to implement. In addition, such solutions have physical limitations as to how fast a reference clock can be made. Consequently, it is desirable to provide an improved digital timing circuit for measuring time of arrival of an asynchronous event. The digital timing circuit should be able to accurately measure the time of arrival of an asynchronous event without relying on expensive clock circuits.

SUMMARY OF THE INVENTION

In accordance with a preferred embodiment of the present invention, a timing circuit includes a counter, a register, a gray code-to-binary converter, and a cascade circuit. In response to a time of arrival of a trigger signal that denotes an occurrence of an asynchronous event, the counter generates a set of high-order binary bits and the register generates a set of gray code bits. The gray code-to-binary converter then converts the set of gray code bits to a set of low-order binary bits. Finally, the cascade circuit concatenates the high-order binary bits and the low-order binary bits to form the time of arrival of the asynchronous event.

More specifically, embodiments of the present invention provide a timing circuit for measuring time of arrival of an asynchronous event. The timing circuit includes a counter to provide plurality of high-order binary bits. A latch connected to the counter, is provided to latch the plurality of high-order binary bits received from the counter. A register, responsive to an event trigger signal that denotes an occurrence of an asynchronous event, provides a plurality of gray code bits. An event circuit connected to the latch, is responsive to occurrence of the event trigger signal and responsive to the plurality of gray code bits from the register to arbitrate results between the counter and the register to thereby compensate for a time of arrival error resulting from an occurrence of a capture of an event signal during a period of uncertainty. This arbitration of results can be accomplished by selectively advancing or delaying enabling of the latch of the high order binary bits. The event circuit can include an event flip-flop circuit, clocked by the event trigger signal, to latch or to indicate the occurrence of an event, a synchronizing flip-flop circuit, connected to the event flip-flop circuit to provide a synchronized output state indicating occurrence of the asynchronous event, and an adjustment circuit that is connected to the synchronizing flip-flop circuit, the register, and the latch to resolve any disagreement between the output state of the synchronizing flip-flop and the output state of the register. The latch can include an enable input and the adjustment circuit can provide a delayed enabling signal to the latch to thereby provide such functionality. A clock oscillator can be used to simultaneously clock the counter, the delay circuit, and the latch, to provide synchronization within the timing circuit. A gray code-to-binary converter, connected to the register, is also provided to convert the plurality of gray code bits to a plurality of low-order binary bits. Further, a cascade circuit, connected to the gray code-to-binary converter and latch, can be provided to concatenate the plurality of high-order binary bits and low-order binary bits to form the time of arrival of the asynchronous event.

Embodiments of the present invention also include methods for measuring time of arrival of an asynchronous event. For example, a method for measuring time of arrival of an asynchronous event can include counting clock pulses between an initiating event and an arrival of an asynchronous event. The counted pulses are in the form of a binary number indicating an elapsed time between the initiating event and the arrival of the asynchronous event. A time of the arrival of the asynchronous event within a period of one of the clock pulses is recorded and generated in the form of a plurality of gray code bits. The gray code bits are converted to a binary number indicating a fraction of a clock period. The binary number indicating an elapsed time between the initiating event and the arrival of the asynchronous event and the binary number indicating the fraction of the clock period are synchronized, responsive to the plurality of gray code bits and the arrival of the asynchronous event. This synchronization can correct a misinterpretation resulting from receiving an indication of the arrival of the asynchronous event during a period of uncertainty. Synchronization can be accomplished by advancing or delaying combining the binary number indicating the elapsed time between the initiating event and the arrival of the asynchronous event with the binary number indicating the fraction of the clock period. Upon synchronization, the binary number indicating the elapsed time between the initiating event and the arrival of the asynchronous event is combined with the binary number indicating the fraction of the clock period to form the time of arrival of the asynchronous event.

All objects, features, and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

Figure 1:
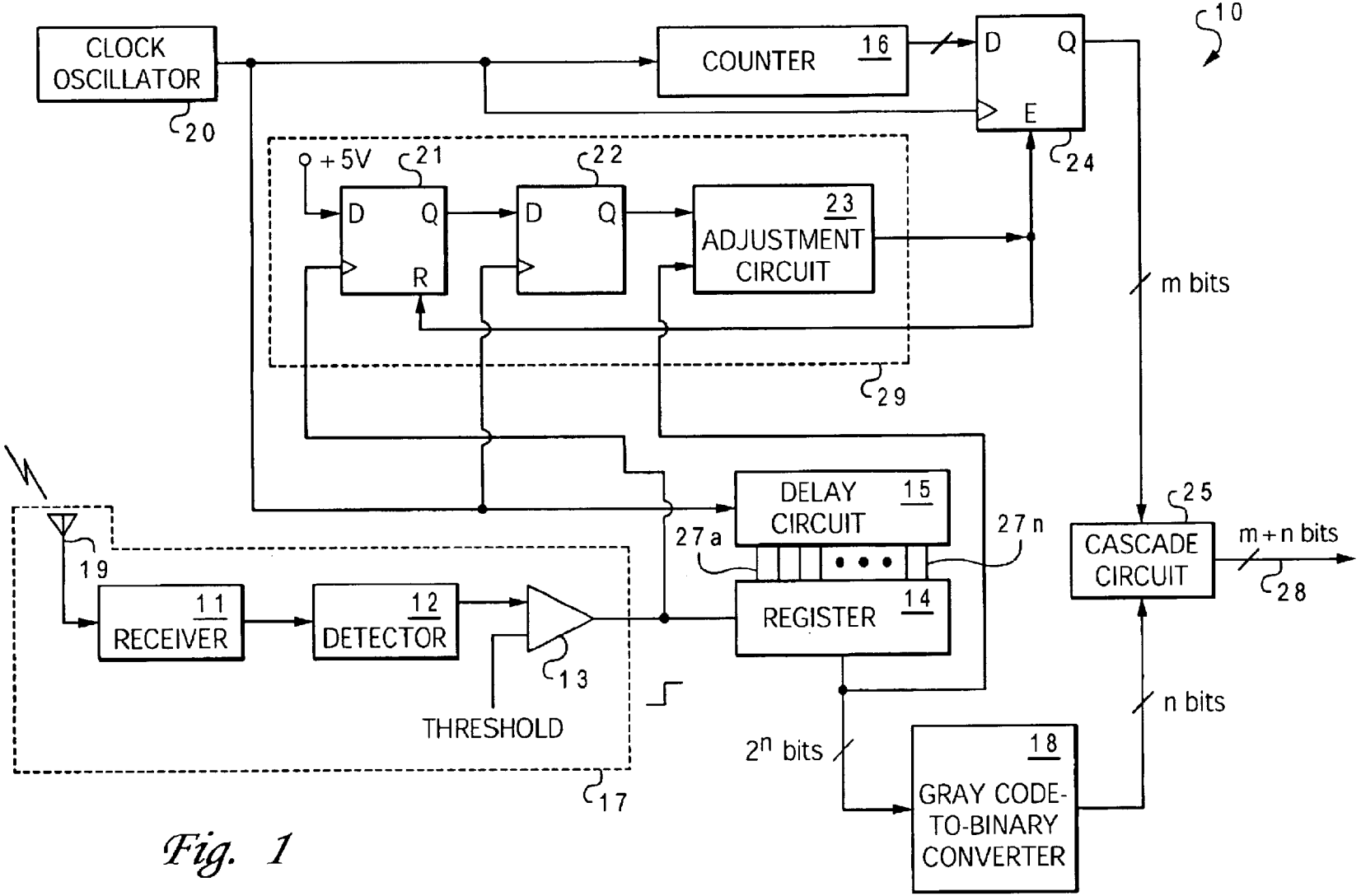
FIG. 1 is a block diagram of a timing circuit along with a pulse detection circuit, in accordance with a preferred embodiment of the present invention.

Referring now to the drawings and in particular to FIG. 1, there is illustrated a block diagram of a timing circuit 10 along with a pulse detection circuit 17, in accordance with a preferred embodiment of the present invention. As shown, pulse detecting circuit 17 includes an antenna 19 and a receiver 11 for receiving a signal. The signal can be, for example, an electromagnetic or acoustic signal. After amplifying and conditioning the signal received by antenna 19, receiver 11 sends the received signal to a detector 12. Detector 12, which is preferably formed by a series of operational amplifiers and diode detectors, then sends the received signal to a comparator 13 that includes a threshold input for eliminating spurious signals. Any signal occurs at the output of comparator 13 (i.e., the output of pulse detecting circuit 17) can be treated as a trigger signal that denotes an arrival of an asynchronous event.

In accordance with a preferred embodiment of the present invention, the actual time of arrival of the trigger signal is measured by a counter 16 and a register 14 that is coupled to a delay circuit 15. In the present implementation, counter 16 is an m-bit counter and register 14 is a 2"-bit register. A stable reference clock signal is provided to counter 16 by a clock oscillator 20. Counter 16 measures the "coarse" value of the time of arrival of the trigger signal. For example, m bits of counter 16 may yield the minute or second portion for the time of arrival of the trigger signal. The resolution of counter 16 is dictated by the period (i.e., 1/frequency) of a clock signal from clock oscillator 20. The number of bits within counter 16 dictates the unambiguous measurement interval for timing circuit 10. The unambiguous measurement interval is the time in which a clock measurement becomes unambiguous. For example, the unambiguous measurement interval for an analog clock is 12 hours, and the unambiguous measurement interval for counter 16 is preferably in the range of a few seconds. The bits of counter 16 are captured by a latch 24 (such as a D-type flip-flop circuit). The capture of m bits from counter 16 is activated by a trigger signal from the output of comparator 13, which is the same trigger signal received by register 14. As shown, the trigger signal from the output of comparator 13 activates an event circuit 29 that subsequently activates latch 24 via an enable input of latch 24 to capture m bits from counter 16. The activation of latch 24 must occur synchronously with the clock cycle of a clock signal from clock oscillator 20 in order to achieve reliable operations.

Event circuit 29 preferably includes an event flip-flop circuit 21, a synchronizing flip-flop circuit 22, and an adjustment circuit 23. The output of event flip-flip circuit 21 is coupled to the input of synchronizing flip-flop circuit 22 that preferably changes state on a rising edge of a clock signal from clock oscillator 20. The output of synchronizing flip-flop circuit 22 is coupled to a first input of adjustment circuit 23. The second input of adjustment circuit 23 receives 2" output bits from register 14.

Register 14 is coupled to delay circuit 15 via multiple delay lines (or tap lines) 27*a*–27*n*. When a trigger signal (from the output of comparator 13) arrived at register 14, the state of delay circuit 15 is instantaneously captured by register 14. The detail of the capturing process is further explained infra. The 2" bits output from register 14, which are in gray code form, are sent to a gray code-to-binary converter 18 that is well-known to those skilled in the art. Gray code-to-binary converter 18 then converts the 2" gray code bits to n binary bits that represent the fraction of a clock period for the time of arrival of the trigger signal. The resolution of register 14 and also the resolution of gray code-to-binary converter 18 are dictated by the number of delay lines 27*a*–27*n* from delay circuit 15.

Delay circuit 15 is also provided with a stable reference clock signal by clock oscillator 20. Delay circuit 15, which preferably includes multiple delay elements (not shown), produces a delayed fraction of a clock signal from clock oscillator 20 at the output of each delay element. For example, if delay circuit 15 has 8 delay elements, then each of the delay lines provides a delay time equal to the fraction of the period of the clock signal from clock oscillator 20 divided by 8.

The purpose of adjustment circuit 23 is to compensate for any error resulting from meta-stable trigger signals being captured. When a signal is captured by a D-type flip-flop circuit using an asynchronous trigger, there is always a period of time (meta-stable period) typically immediately before a clock edge, where the input can change but that change may or may not be reflected in the output of the D-type flip-flop circuit. Thus, if multiple signals are captured by multiple D-type flip-flop circuits during such period of uncertainty, the interpretation of the resultant output from the D-type flip-flop circuit can be chaotic, i.e., the accuracy of each output can be in doubt. For example, meta-stable signal capturings may occur in each of the D-type flip-flop circuits within register 14 during such period of uncertainty. However, due to the gray code nature of delay lines 27*a*–27*n*, only one of the inputs can fall into the period of uncertainty for any asynchronous event. Thus, the worst case error is 1 least significant bit. A second possibility for a meta-stable condition occurs when the output of the event flip-flop 21, indicating the occurrence of an asynchronous event, being captured by flip-flop 22 during the period of uncertainty. A misinterpretation of such signals can result in a time of arrival error of plus/minus one clock signal period or n least significant bits (see FIG. 1). To avoid such uncertainty, the output from register 14 is preferably taken as the correct answer, and if there is a disagreement between the information contained in the output from register 14 and the output state of synchronizing flip-flop circuit 22. An Enable signal from adjustment circuit 23 is advanced or retarded as necessary to correct for any erroneous output of synchronizing flip-flop circuit 22. In such situation, adjustment circuit 23 will logically select the last true output of register 14, and upon a rising edge of a signal from synchronizing flip-flop circuit 22 will output an Enable signal to an enable input of latch 24, effectively arbitrating or synchronizing the results between the counter 16 and the register 14. The Enable signal is also used to reset event flip-flop circuit 21 via a reset input of event flip-flop circuit 21 to its quiescent state.

The m bits from latch 24 and the n bits from gray code-to binary converter 18 are subsequently concatenated by a cascade circuit 25 to become an output having m+n bits. The m+n bits output is then sent to an output line 28.

Figure 2:
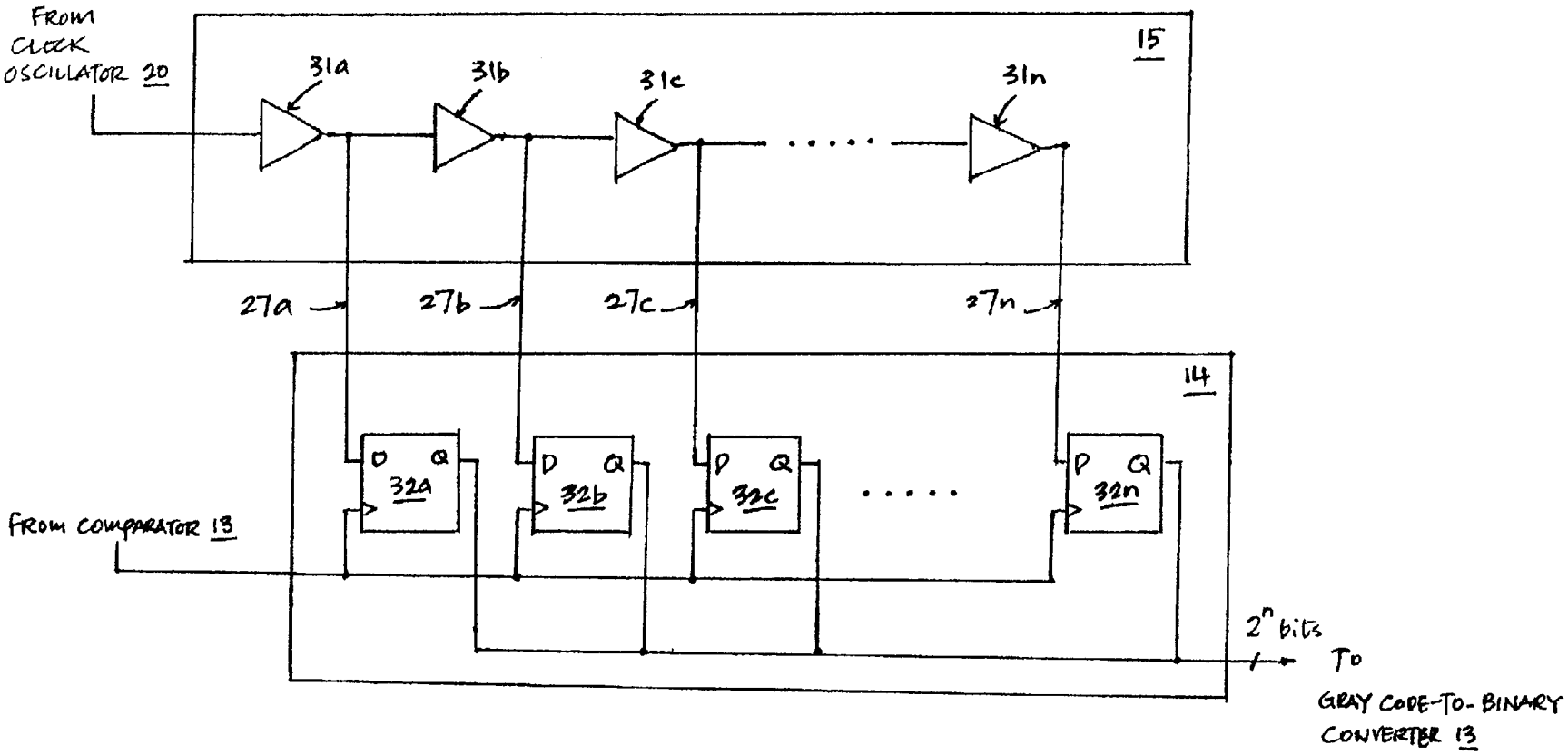
FIG. 2 is a block diagram of a delay circuit and a register within the timing circuit from FIG. 1, in accordance with a preferred embodiment of the present invention.

With reference now to FIG. 2, there is illustrated a detailed block diagram of delay circuit 15 and register 14, in accordance with a preferred embodiment of the present invention. As shown, delay circuit 15 includes delay elements 31*a*–31*n*, and register 14 includes D-type flip-flop circuits 32*a*–32*n*. Each of delay elements 31*a*–31*n* may be formed by two inverters connected in series, but preferably, each of delay elements 31*a*–31*n* is formed with a lumped inductor-capacitor circuit with the capacitor connected to ground. The output of each of delay elements 31*a*–31*n* is connected to the input (D) of each of flip-flop circuits 32*a*–32*n* via a respective one of delay lines 27*a*–27*n*. The outputs (Q) of flip-flop circuits 32*a*–32*n* are all coupled to gray code-to-binary converter 18 (from FIG. 1). The clock inputs of flip-flop circuits 32*a*–32*n* are provided by the output of comparator 13 (from FIG. 1). The total number of delay elements 31*a*–31*n*, and accordingly flip-flop circuits 32*a*–32*n*, is preferably in the power of 2.

Figure 3:
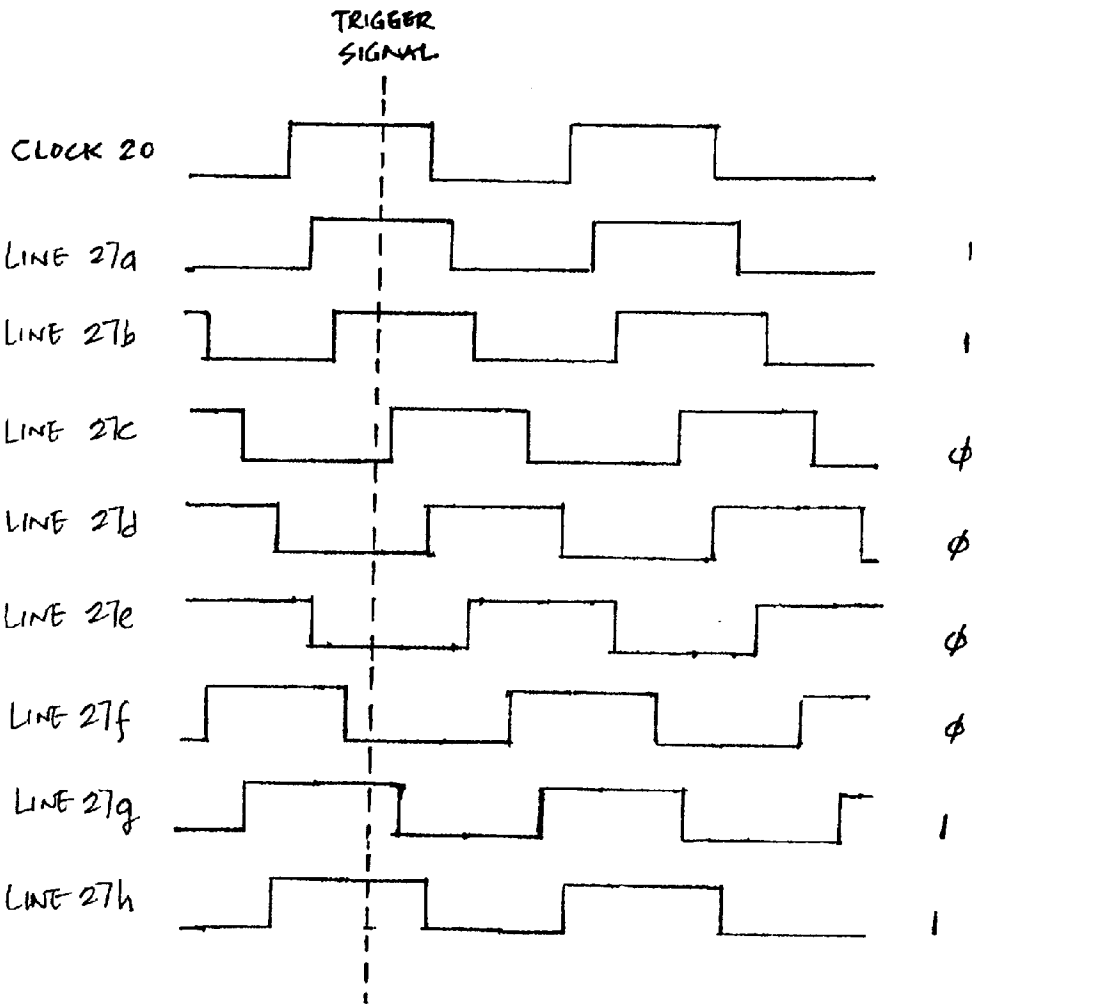
FIG. 3 is an exemplary timing diagram depicting the waveforms generated by various delay lines of the delay circuit from FIG. 2, in accordance with a preferred embodiment of the present invention.

Referring now to FIG. 3, there is illustrated a timing diagram depicting the waveforms generated by various delay lines from delay circuit 15 (from FIG. 2), in accordance with a preferred embodiment of the present invention. The clock signal from clock oscillator 20 is the reference clock signal for delay circuit 15. In this example, delay circuit 15 has eight delay elements, and each of the eight delay elements provides a respective delay line, namely, delay lines 27*a*–27*h*. When a trigger signal arrives at the clock input of register 14 (from FIG. 2), a snapshot of the state of each delay lines 27*a*–27*h* at that instant is captured by a respective flip-flop circuit within register 14. Preferably, a positive pulse on a delay line is captured as a logical "1," and a negative pulse on a delay line is captured as a logical "0." Thus, the states of delay lines 27*a*–27*h* shown in FIG. 3 are captured as "111000011." As mentioned previously, the captured bits (2" bits) are preferably in gray code form. Gray code is an ordering of binary numbers such that only one bit changes from one entry to the next. (Technically, the captured bits are not gray code bits because one bit changes from a logical "1" to a logical "0" while another bit changes from a logical "0" to a logical "1." However, the transition from a logical "0" to a logical "1" is ignored in translating the captured bits, so the captured bits can be treated as gray code bits.) The 2" captured bits are then converted by gray code-to-binary converter 18 (from FIG. 1) to a binary number of n bits. The n bits represent the fraction of the interval between m clock periods.

An alternative embodiment of timing circuit 10 can be implemented by sending the trigger signal to the input of delay lines 27*a*–27*n*, and capturing the state of delay element 31*a*–31*n* at the instant of a clock edge to determine the fraction of a clock period before the trigger signal. Event flip-flop circuit 21, synchronizing flip-flop circuit 22, and adjustment circuit 23 are still required for the alternative embodiment.

In summary, the length of one complete clock signal from clock oscillator 20 is divided by the total number of delay lines within delay circuit 15, thereby matching the delay to the period of a clock signal. An asynchronous event, in the form of a trigger signal, triggers the capture of the elapsed time of the clock in counter 16, and the point in the clock cycle of the receipt of the asynchronous event. For the point in the clock cycle, the state of the delay lines within delay circuit 15 is captured by register 14 to provide a set of bits in gray code form. The gray code bits are then converted to binary bits to represent a precise fraction of one clock cycle. A precise time of arrival of the asynchronous event can be generated by concatenating the binary bits to the bits from counter 16.

As has been described, the present invention provides an improved digital timing circuit for measuring time of arrival of an asynchronous event. The accuracy of the timing circuit of the present invention is limited only by the aperture jitter or the dispersion that can be held to fractions of a nanosecond.

While the invention has been particularly shown and described with reference to a preferred embodiment, it will be understood by those skilled in the art that various changes in form and detail may be made therein without departing from the spirit and scope of the invention.

What is claimed is:

1. A timing circuit for measuring time of arrival of an asynchronous event, said timing circuit comprising:

a counter to provide a plurality of high-order binary bits;

a latch connected to the counter to latch the plurality of high-order binary bits received from the counter;

a register responsive to an event trigger signal that denotes an occurrence of an asynchronous event to provide a plurality of gray code bits;

an event circuit connected to the latch, responsive to occurrence of the event trigger signal, and responsive to the plurality of gray code bits from the register to arbitrate results between the counter and the register to thereby compensate for a time of arrival error resulting from an occurrence of a capture of an event signal during a period of uncertainty;

a gray code-to-binary converter, connected to the register, to convert the plurality of gray code bits to a plurality of low-order binary bits; and a cascade circuit connected to the gray code-to-binary converter and the latch to concatenate the plurality of high-order binary bits and low-order binary bits to form the time of arrival of the asynchronous event.

2. The timing circuit of claim 1, further comprising a clock having a clock signal, wherein the plurality of gray code bits define an output state of the register, and wherein the event circuit includes an event flip-flop circuit, responsive to occurrence of the event trigger signal, to provide pp output state indicating occurrence of the asynchronous event, a synchronizing fin-flog circuit connected to the event flip-flop circuit, responsive to the event flip-flop circuit output state and to the clock signal, to provide a synchronized output state indicating occurrence of the asynchronous event synchronized with the clock signal, and an adjustment circuit connected to the synchronizing flip-flop, the register, and the latch, responsive to the output state of the synchronizing flip-flop and the output state of the register, to compare the output state of the synchronizing flip-flop circuit with the output state of the register to thereby resolve a disagreement between the output state of the synchronizing flip-flop and the output state of the register, in the event the disagreement occurs.

3. The timing circuit of claim 2, wherein the period of uncertainty includes a period of time immediately before a clock edge when an input to the synchronizing flip-flop circuit obtained from the output of the event flip-flop can be changed without causing a corresponding change in the output state of the synchronizing flip-flop circuit.

4. The timing circuit of claim 2, wherein the adjustment circuit advances or delays enabling the latch when the output state of the synchronizing flip-flop disagrees with the output state of the register.

5. The timing circuit of claim 1, wherein the timing circuit further comprises a delay circuit, responsive to a reference clock signal and having a plurality of tap lines, to provide a delayed fraction of the reference clock signal defining a state of the delay circuit, and wherein the register includes a plurality of flip-flop circuits, each flip-flop circuit connected to one of the plurality of tap lines, responsive to the event trigger signal, and positioned to capture the state of the delay circuit.

6. The timing circuit of claim 5, wherein the timing circuit further includes a clock connected to the counter and the delay circuit to provide the counter and the delay circuit a stable reference clock signal, and wherein the latch is activated synchronously with a clock cycle of the clock signal.

7. The timing circuit of claim 5, wherein the delay circuit includes a plurality of delay elements, and wherein each delay element is connected to one of the plurality of tap lines connected to the register.

8. The timing circuit of claim 7, wherein one of the delay elements includes a lumped inductor-capacitor circuit.

9. The timing circuit of claim 1, wherein the event circuit arbitrates results between the counter and the register by selectively delaying enabling of the latch of the high order binary bits to thereby allow the counter value to increase count prior to being latched.

10. The timing circuit of claim 1, wherein a value of the gray code bits represents a fraction of a clock period that has expired in response to the time of arrival of the event trigger signal.

11. The timing circuit of claim 1, wherein the plurality of high-order binary bits represents the time of arrival of the asynchronous event.

12. The timing circuit of claim 1, wherein the plurality of low-order binary bits represents a fraction of a clock period within the time of arrival of the asynchronous event.

13. A method for measuring time of arrival of an asynchronous event, the method comprising:

counting clock pulses between an initiating event and an arrival of an asynchronous event, wherein the counted clock pulses are in the form of a first binary number indicating an elapsed time between the initiating event and the arrival of the asynchronous event;

recording a time of the arrival of the asynchronous event within a period of one of the clock pulses;

generating the recorded time as a plurality of gray code bits;

converting the gray code bits to a second binary number indicating a fraction of a clock period;

synchronizing the first binary number indicating an elapsed time between the initiating event and the arrival of the asynchronous event and the second binary number indicating the fraction of the clock period, responsive to the plurality of gray code bits and the arrival of the asynchronous event; and combining the first binary number indicating the elapsed time between the initiating event and the arrival of the asynchronous event with the second binary number indicating the fraction of the clock period to thereby form the time of arrival of the asynchronous event.

14. The method of claim 13, further comprising the step of latching the binary number indicating an elapsed time between the initiating event and the arrival of the asynchronous event; and the initiating event comprises a reference event, wherein the step of synchronizing includes the step of compensating for an error in the count of the clock pulses resulting from receiving an indication of the arrival of the asynchronous event during a period of uncertainty and wherein the step of compensating for an error includes the step of advancing or delaying latching of the first binary number indicating an elapsed time between the initiating event and the arrival of the asynchronous event.

15. The method of claim 13, wherein the step of combining further includes concatenating the binary number indicating an elapsed time between the initiating event and the arrival of the asynchronous event and the second binary number indicating the fraction of the clock period to form the time of arrival of the asynchronous event.

16. The method of claim 13, wherein the step of synchronizing further comprises the step of advancing or delaying combining the first binary number indicating the elapsed time between the initiating event and the arrival of the asynchronous event with the second binary number indicating the fraction of the clock period by selectively advancing or delaying enabling latching of the first binary number indicating the elapsed time between the initiating event and the arrival of the asynchronous event.

17. An apparatus for measuring time of arrival of an asynchronous event, the apparatus comprising:

means for counting clock pulses between an initiating event and an arrival of an asynchronous event, wherein the counted clock pulses are in the form of a first binary number indicating an elapsed time between the initiating event and the arrival of the asynchronous event;

means, connected to the means for counting clock pulses, for latching the first binary number from the means for counting clock pulses;

means for recording a time of the arrival of the asynchronous event within a period of one of the clock pulses;

means for generating the recorded time as a plurality of gray code bits;

means, connected to the means for generating the recorded time and means for latching the first binary number, for arbitrating results between the means for counting clock pulses and means for generating the recorded time, responsive to the plurality of gray code bits, to compensate for an error in a resolution of the means for counting clock pulses;

means for converting the gray code bits to a second binary number indicating a fraction of a clock period; and means for combining the first binary number indicating an elapsed time between the initiating event and the asynchronous event and the second binary number indicating the fraction of the clock period to form the time of arrival of the asynchronous event.

18. The apparatus of claim 17, wherein the initiating event comprises a reference event, and wherein the means for arbitrating results arbitrates the results between the means for counting clock pulses and means for generating the recorded time by selectively advancing or delaying enabling of the means for latching the first binary number.

19. The apparatus of claim 17, wherein the means for combining further includes means for concatenating the first binary number indicating an elapsed time between the initiating event and the arrival of the asynchronous event and the second binary number indicating the fraction of the clock period to form the time of arrival of the asynchronous event.

20. The apparatus of claim 17, wherein the error in the resolution of the means for counting clock pulses results from receiving an indication of the arrival of the asynchronous event during a period of uncertainty.

* * * * *